US009350075B2

(12) United States Patent
Collins et al.

(10) Patent No.: US 9,350,075 B2
(45) Date of Patent: May 24, 2016

(54) BRANCHED MULTIPORT ANTENNAS

(75) Inventors: Brian Collins, Cambridge (GB); Devis Iellici, Cambridge (GB); Simon Philip Kingsley, Cambridge (GB); Timothy John Palmer, Cambridge (GB); Raul Recio Perez, Aranda de Duero (ES)

(73) Assignee: Microsoft Technology Licensing, LLC, Redmond, WA (US)

( * ) Notice: Subject to any disclaimer, the term of this patent is extended or adjusted under 35 U.S.C. 154(b) by 619 days.

(21) Appl. No.: 13/320,087

(22) PCT Filed: May 11, 2010

(86) PCT No.: PCT/GB2010/050762

§ 371 (c)(1),
(2), (4) Date: Jan. 23, 2012

(87) PCT Pub. No.: WO2010/131027

PCT Pub. Date: Nov. 18, 2010

(65) Prior Publication Data

US 2012/0112968 A1 May 10, 2012

(30) Foreign Application Priority Data

May 13, 2009 (GB) ..... 0908195.1

(51) Int. Cl.
*H01Q 5/00* (2015.01)
*H01Q 1/36* (2006.01)
(Continued)

(52) U.S. Cl.
CPC . *H01Q 5/00* (2013.01); *H01Q 1/36* (2013.01); *H01Q 1/38* (2013.01); *H01Q 5/371* (2015.01); *H01Q 9/0407* (2013.01)

(58) Field of Classification Search
CPC ..... H01Q 1/38; H01Q 9/0407; H01Q 9/0421; H01Q 1/243; H01Q 5/0003
USPC ..... 343/700 MS, 702, 866, 846
See application file for complete search history.

(56) References Cited

U.S. PATENT DOCUMENTS 6,184,833 B1 * 2/2001 Tran ..... 343/700 MS
6,842,158 B2 * 1/2005 Jo ..... H01Q 1/243 343/700 MS (Continued)

FOREIGN PATENT DOCUMENTS

JP 2002-335114 * 11/2002
JP 2009-065315 3/2009

(Continued)

OTHER PUBLICATIONS

International Search Report and Written Opinion issued for PCT/GB2010/050762 and dated Aug. 17, 2010.

(Continued)

*Primary Examiner* — Huedung Mancuso
(74) *Attorney, Agent, or Firm* — Qudus Olaniran; Judy Yee; Micky Minhas

(57) ABSTRACT

There is disclosed a module for an antenna system, the module comprising a dielectric support and a branched electrically conductive pathway formed on or in the support. The pathway comprises at least three arms each having a proximal and a distal end, the proximal ends being joined together or each connected to at least one other of the at least three arms, and the distal ends being separate from each other and configured as terminals. The modules may be configured as chip antennas. A plurality of antenna modules can connected together in order to create antenna systems with particular desired characteristics.

24 Claims, 12 Drawing Sheets

(51) Int. Cl.

| | |
|---|---|
| ***H01Q 1/38*** | (2006.01) |
| ***H01Q 9/04*** | (2006.01) |
| ***H01Q 5/371*** | (2015.01) |

(56) References Cited

U.S. PATENT DOCUMENTS

| | | | | |
|---|---|---|---|---|
| 6,867,736 | B2 * | 3/2005 | Faraone et al. | 343/700 MS |
| 7,116,202 | B2 * | 10/2006 | Alexopoulos et al. | 336/200 |
| 7,423,592 | B2 * | 9/2008 | Pros et al. | 343/700 MS |
| 7,511,675 | B2 * | 3/2009 | Puente-Baliarda et al. | 343/713 |
| 7,619,565 | B2 * | 11/2009 | Chen et al. | 343/700 MS |
| 2002/0163470 | A1 * | 11/2002 | Nagumo | H01Q 1/22 343/700 MS |
| 2004/0001023 | A1 | 1/2004 | Peng | |
| 2006/0012526 | A1 | 1/2006 | Liang et al. | |
| 2007/0188388 | A1 | 8/2007 | Feng et al. | |

FOREIGN PATENT DOCUMENTS

| | | |
|---|---|---|
| WO | WO 2004/001898 | 12/2003 |
| WO | WO 2005/022688 | 3/2005 |

OTHER PUBLICATIONS

"Antenna Engineering Handbook", 4th Edition, J. Volakis, Ed., McGraw-Hill Book Company, New York, 2007, pp. 28-8.

"Second Office Action Received in China Patent Application No. 201080020896.0", Mailed Date: May 4, 2014, Filed Date: May 11, 2010, 3 Pages.

"Third Office Action Issued in Chinese Patent Application No. 201080020896.X", Mailed Date: Nov. 3, 2014, 6 Pages.

* cited by examiner

Basic element

PCB is 40 x 50 x 1.6 mm. Groundplane is 40 x 41 mm.
Antenna element is 7.5 x 7.5 x 0.8 mm.

Fed at Port C: Resonates at 2.75 GHz -16 dB RL. BW = 18% @ GHz -10 dB RL

Fed at Port D: Resonates at 3.01 GHz -24 dB RL. BW = 21% @ GHz -10 dB RL

Fed at Port A: Resonates at 3.41 and 4.22 GHz. BW = 40% @ GHz -10 dB RL

Fed at Port B: Resonates at 3.01 GHz -17 dB RL. BW = 21% @ GHz -10 dB RL

Set-up 1, both tiles fed at Port C:

PCB is 40 x 50 x 1.6 mm

Groundplane is 40 x 41 mm

Antenna element is 7.5 x 7.5 x 0.8 mm

In the low band it resonates at 1.91 GHz @ -22 dB RL. BW = 21% @ GHz -10 dB RL

In the high band it resonates at 3.91 GHz @ -6.5 dB RL

Set-up 2, both tiles fed at the Port A:

In the low band it resonates at 2.10 GHz @ -23 dB RL. BW = 30% @ GHz -10 dB RL

In the high band it resonates at 4.95 GHz @ -11 dB RL

Set-up 3, both tiles fed at the Port C,
but first tile output is at Port D so as to tile horizontally In the low band it resonates at 1.73 GHz @ -4.5 dB RL In the high band it resonates at 4.09 GHz @ -20 dB RL Set-up 4, both tiles fed at the Port A,
but first tile output is at Port B so as to tile horizontally In the low band it resonates at 2.2 GHz @ -8.5 dB RL In the high band it resonates at 4.41 GHz @ -39 dB RL and 5.42 @ -16 dB

BRANCHED MULTIPORT ANTENNAS

CROSS-REFERENCE TO RELATED APPLICATIONS

This application is a National Phase Application of PCT International Application No. PCT/GB2010/050762, International Filing Date May 11, 2010, claiming priority of GB Patent Application 0908195.1, filed May 13, 2009, which are hereby incorporated by reference in their entirety.

FIELD OF THE INVENTION

The present invention relates to antenna systems comprising a plurality of individual antenna elements connected in series and/or in parallel so as to provide a composite antenna that operates in a plurality of different frequency bands.

BACKGROUND

Many frequency bands are used in modern communications systems. Mobile devices, for example, may use five different cellular radio bands plus WLAN, Bluetooth® and mobile TV bands. Each frequency band requires a separate antenna design and so an antenna company has to have many different products on its books and carry a variety of different stock.

It is known, for example from WO 2005/022688, to provide a modular antenna apparatus in which an antenna can be built up from a selection of modules having differing resonance frequencies, the modules being connected in series along a connection conductor. Open terminals of the antenna modules are separate. The antenna structures formed from the modules are relatively simple, and are provided with only a single effective feed port.

In addition, it is a known technique to form an antenna from a branched conductor system in order to increase the bandwidth of a single radiating element or to provide an antenna which operates in more than one frequency band. An example is illustrated in Figure 28-5b in *Antenna Engineering Handbook* ($4^{th}$ Edition, Editor J Volakis, published by McGraw-Hill Book Company, New York, 2007); this design was originated in the 1940s and has been sold commercially and constructed by radio amateurs for many years for use in the HF radio band (3-30 MHz).

JP 2002-335114 discloses a chip antenna designed so that its resonance frequency can be changed adaptively. The chip antenna comprises a meandered conductor embedded in a chip, and three terminals connected to different points on the conductor and all projecting from one edge of the chip. In this way, depending on the terminal selected as the feed, three different lengths of conductor and hence three difference resonance frequencies are immediately available. It is possible to trim the non-feed terminals so as to provide additional tuning.

BRIEF SUMMARY OF THE DISCLOSURE

According to a first aspect of the present invention, there is provided a module for an antenna system, the module comprising a dielectric support and a branched electrically conductive pathway formed on or in the support, the pathway comprising at least three arms each having a proximal and a distal end, the proximal ends being joined together or each connected to at least one other of the at least three arms, and the distal ends being separate from each other and configured as terminals.

Each terminal may be selected as a driving or excitation terminal for connection to a signal feed. In other words, the distal or outwardly-facing ends of the at least three arms can be configured as driving or excitation terminals for the module, which means that each may be used, without special modification in comparison to the others, as a terminal for supplying an excitation or driving current or signal to the module, thereby to excite the arms and cause them to radiate.

It is found that by the suitable selection of the dimensions and shape of each arm of the branched electrically conductive pathway, a resonant frequency or frequencies of the antenna module may be adapted by the choice of which terminal is excited. In other words, an antenna module having at least three conductive arms that are differently dimensioned or shaped or otherwise configured can be operated with at least three different resonant frequencies or frequency bands, depending on which of the distal ends of the arms is used as the driving or excitation terminal.

By this means a single antenna module may be used for multiple purposes.

The proximal ends of the at least three arms may all be joined together (for example, electrically or galvanically connected) at a common junction point.

Alternatively, at least two of the proximal ends may be joined together at a common junction point, and the remaining proximal ends may be connected to the pathway at other locations.

Alternatively, there may be no common junction point, and the proximal ends are connected to the pathway at different locations.

What is important is that the pathway is formed as a branched structure having at least three arms branching off a common "trunk" conductor.

The pathway may be formed substantially in two dimensions (i.e. in a single plane), or may be formed in three dimensions.

In particularly preferred embodiments, the module is configured with the distal ends of the arms (i.e. the terminals) at edges, corners or faces of the module in such a way that a plurality of modules can be connected together, a terminal of one module being electrically connected to a terminal of an adjacent module. Individual modules will generally be connectable to adjacent modules in series, although pathways having connections in parallel can be formed with a plurality of modules, depending on the particular configuration of the individual pathways and the resulting collective pathway.

Each of the terminals, preferably located at peripheral (e.g. edge or corner) portions of the module or the support, is configurable as a feeding point or an interconnection point to a neighbouring module, or may not be connected to anything else. It will be appreciated that, in preferred embodiments, branches or sections of the pathway that terminate within the periphery of the module or support are not intended to provide terminal connections, but instead serve to modify the impedance behaviour of the antenna.

This opens up exciting possibilities in antenna design—not only does each module have selectable antenna properties depending on which terminal is chosen as the driving or excitation terminal, but a composite antenna system having selectable properties can be built up from a two or three dimensional mosaic of modules that are electrically interconnected through their respective terminals.

In this respect, among others, embodiments of the present invention provide an entirely surprising technical effect over the chip antennas of, for example, JP 2002-335114, which are designed as individual, independent antennas that are not designed in a manner to allow a compound antenna easily to be constructed from a 2D or 3D mosaic of modular chip antennas.

According to a second aspect of the present invention, there is provided a composite antenna system comprising a plurality of modules of the first aspect, at least one terminal of each module being connected to at least one terminal of an adjacent module.

By selecting modules having particular pathway or branch configurations, and connecting these together in particular ways, it is possible to build composite antenna systems have a wide variety of different and selectable performance characteristics, all from simple modular components. Indeed, many different composite antenna systems can be constructed from a kit of parts comprising a plurality of identical modules by interconnecting the modules in different ways.

An antenna structure comprising a system of branched conductors can be created such that by connecting different branch ends or terminals to the exciting signal source (or receiver) the antenna operates on one or more different frequency bands.

For the avoidance of doubt, it is to be understood that antennas of the present invention may be used both for transmitting signals, in which case a feed signal is supplied to a terminal from an transmitter and the conductive pathway or at least parts thereof act as a radiator, and also for receiving signals, in which case an incoming RF wave generates a current in the pathway or parts of the pathway, and the current then passes to a terminal and thence to a receiver.

When two or more of the antenna modules described above are connected, for example in series, to provide a further selection of properties, the associated resonant frequencies may be defined by the selection of the driving terminal and also the selection of the terminal(s) for interconnection.

The composite antennas formed in the manner described may be configured as balanced antennas, in which the antenna is formed from two similar groups of modules and is excited by an electrically balanced feedline system, or may be an unbalanced antenna in which a single group of one or more connected module assemblies is fed against ground. The configuration of the composite antennas may take the form of one or more loops The composite antenna system may be formed by a plurality of identical antenna modules connected together, or by a combination of different types of antenna modules (e.g. antennas having different resonant frequencies, different radiating structures and so forth). Different branch chains may comprise different forms of constituent antennas.

In a preferred embodiment, the antenna modules are formed from conductive tracks supported by an insulating dielectric substrate. This type of module construction is commonly known as a "chip antenna".

In these embodiments, the chip antennas may be provided with connection pads, comprising at least one input connection pad and at least two output connection pads. Additional pads, either for electrical or physical connection to various components, may be present.

The constituent antennas may be positioned in any mutual relationship in space, forming a planar or three-dimensional assemblage (with or without gaps or spacers or additional substrates therebetween).

In particularly preferred embodiments, the connection pads on each antenna module are configured and/or located so as to facilitate connection between adjacent modules in different orientations. For example, where the modules have a generally square, tile-shaped construction, a connection pad is preferably formed at a centre of each edge of each tile. In this way, adjacent tiles can easily be connected in series at any 90 degree rotation of one tile relative to another in a plane containing both tiles.

The terminals of adjacent or neighbouring modules may be connected by soldering, and/or by way of springs or clamps or other electrical/mechanical connections.

It will be noted that in particular embodiments, an assemblage of modules may be topologically similar, in terms of the conductive pathway, to an individual module.

Advantageous and novel features of at least some embodiments of the present invention are the provision of a branched antenna structure with multiple ports (terminals) at which it may be driven, and also in the corresponding design optimisation enabling the antenna to operate in different selected frequency bands or combinations of frequency bands according to its mode of connection.

In addition to the main branched electrically conductive pathway, modules of embodiments of the present invention may further include one or more parasitic conductive elements, for example conductive tracks or elements that do not connect to any other track or element or component, or are open terminated.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

BRIEF DESCRIPTION OF THE DRAWINGS

For a better understanding of the present invention and to show how it may be carried into effect, reference shall now be made by way of example to the accompanying drawings, in which.

11*a* Balanced edge-centre driven with coplanar tiles;

11*b* Balanced corner-driven with coplanar tiles;

11*c* Balanced edge-centre driven with non co-planar tiles;

11*d* Balanced corner drive with tiles in parallel planes

11*e* Unbalanced corner drive with tile parallel with groundplane

FIGS. 12 to 15 show the frequency response of an exemplary tile antenna driven from each of its four ports in turn; and FIGS. 16 to 23 show plots of return loss for two tiled chip antennas in three different configurations as illustrated.

DETAILED DESCRIPTION

Figure 1:
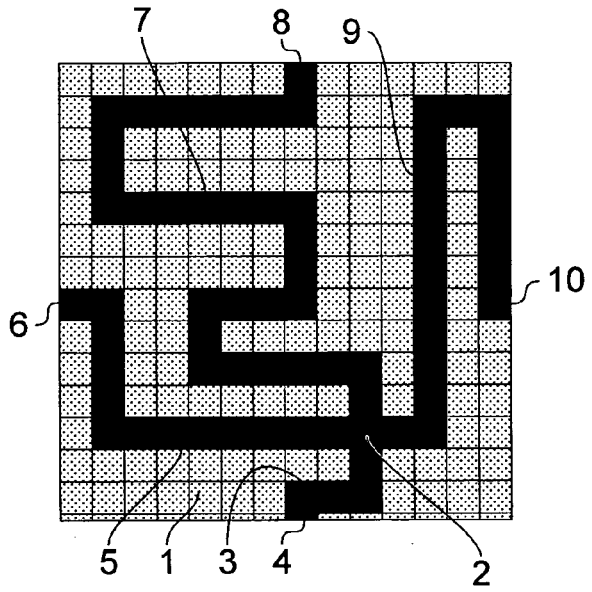
FIG. 1 shows an embodiment of the present invention.

FIG. 1 shows a typical embodiment of the present invention as a chip antenna in which an insulating substrate 1 supports a plurality of conductive members 3, 5, 7, 9 each connected at an inner end to a common junction point 2. The outer end 4, 6, 8, 10 of each conductive member 3, 5, 7, 9 terminates at a position located close to the outer edge of the substrate 1. In this exemplary embodiment the number of conductor branches is four, but any number of branches can be used according to the requirements of the application.

Figure 2:
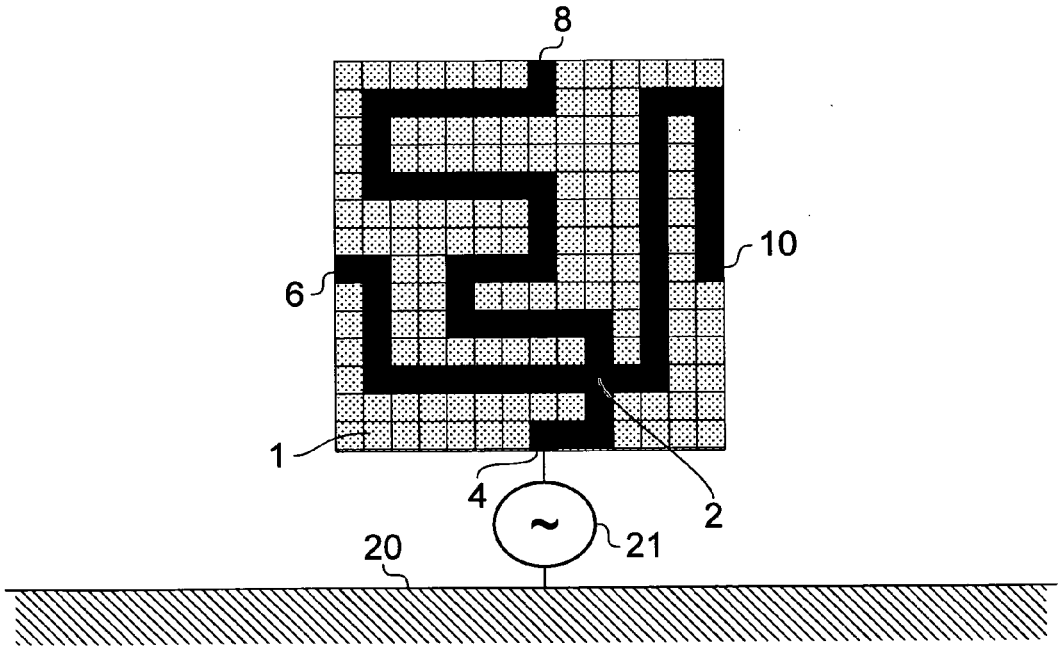
FIG. 2 shows an embodiment of the present invention mounted at the end of a groundplane and driven from one terminal as an unbalanced antenna.

FIG. 2 shows an antenna structure as described herein mounted proximate to a conductive groundplane 20. The plane of the antenna structure may be either coplanar with or orthogonal to that of the groundplane. A radio frequency transmitter or receiver 21 is connected between terminal 4 of the antenna structure and the groundplane 20. This connection is shown symbolically, but in a practical embodiment the connection will be made using a convenient form of radio frequency transmission line such as coaxial cable, microstrip line or coplanar waveguide according to the frequency and power level for which the antenna is intended.

Figure 3:
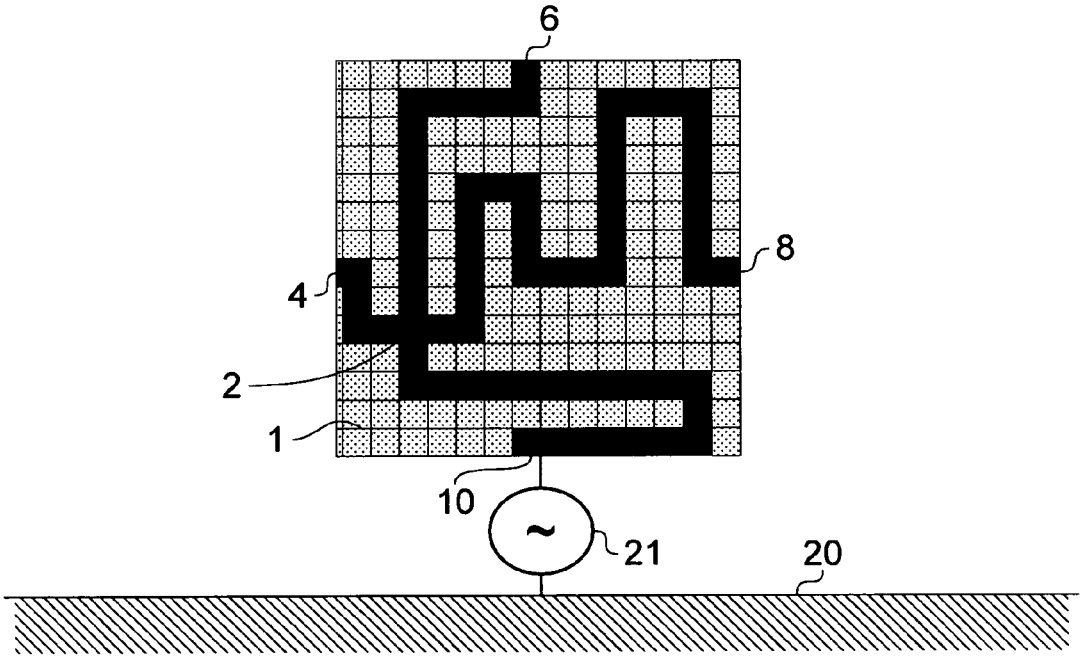
FIG. 3 shows the same arrangement as FIG. 2 but with the antenna driven from a different terminal.

FIG. 3 shows an identical antenna structure to that in FIG. 2, but with the structure rotated such that terminal 10 is proximate to the groundplane 20. In this configuration the resonant frequency of the antenna is different from that in the configuration shown in FIG. 2. The antenna structure may be further rotated and fed between terminals 8 and ground or terminal 6 and ground. In each of the four configurations described the frequency band over which the antenna will operate effectively may be different according to the lengths and configuration of the conductive members. This means that a single design of antenna module can be used in four different configurations for four different operating frequency requirements. Accordingly, there a significant cost savings to be had when large numbers of antenna modules are produced, since one design can be used in different applications, even when the operating frequency requirements are different. The resonant frequency and operating bandwidth of the antenna structure when fed from each terminal in turn can be adjusted or optimized by suitable choice of the lengths of conductive elements 3, 5, 7, 9, the position of the common junction 2 and the dimensions of the substrate 1.

Figure 4:
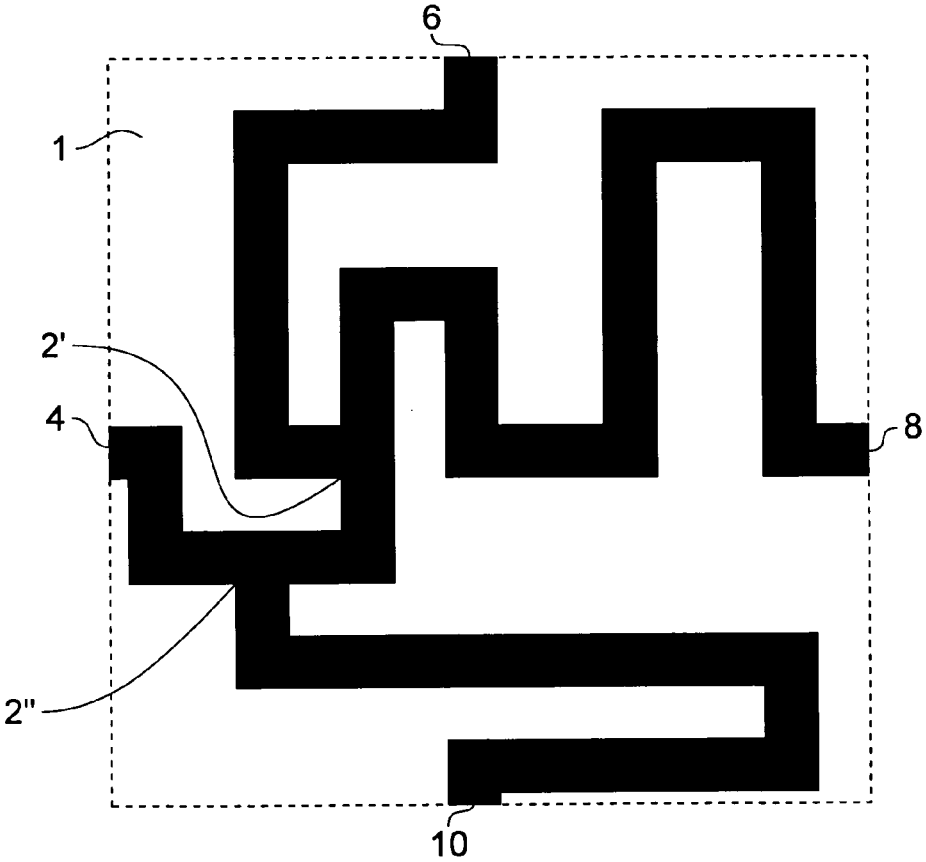
FIG. 4 shows an alternative track layout with separate junction points for each pair of conductors.
Figure 5:
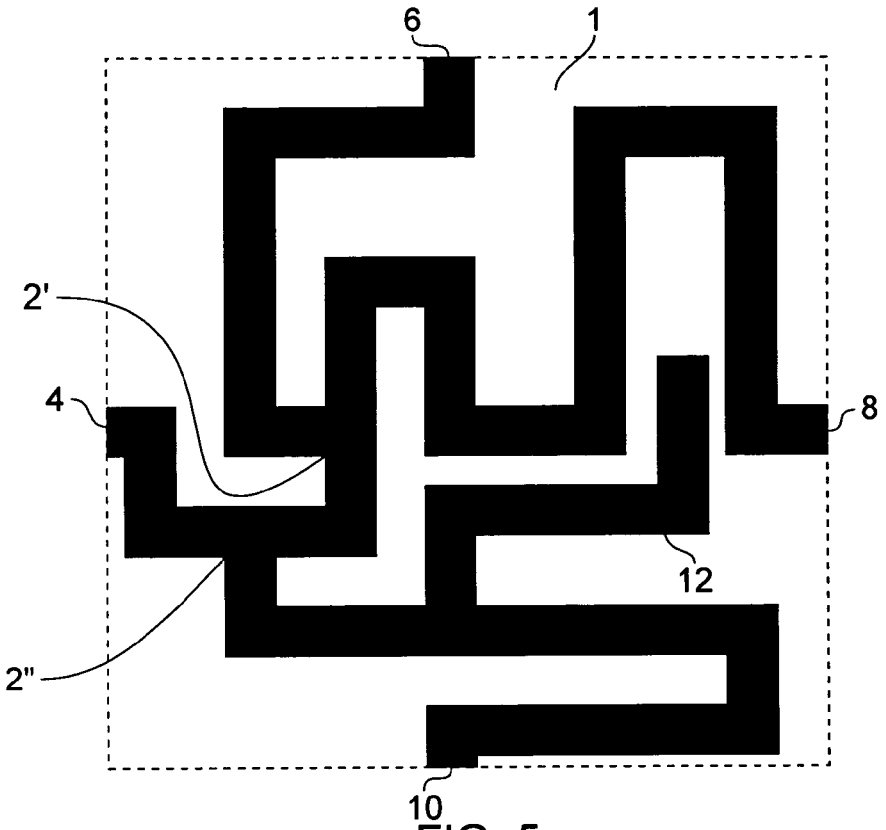
FIG. 5 shows an embodiment with an unterminated conductive track.
Figure 6:
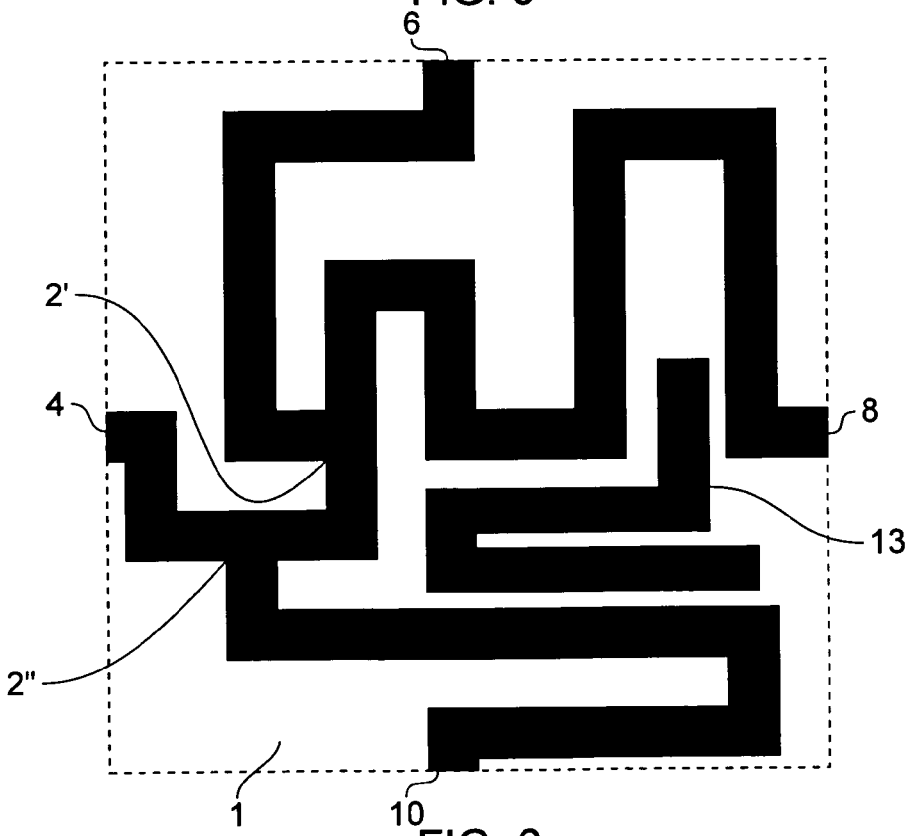
FIG. 6 shows an embodiment with a parasitic conductive track.

In the exemplary embodiment shown in FIGS. 1, 2 and 3 the four conductive elements 3, 5, 7, 9 converge at a single point of junction 2, but in other embodiments the conductive elements may be connected in any other branching pattern as exemplified in FIG. 4 (which has two junction points 2' and 2") or by any combination of branching patterns. The total number of branches and terminals may be chosen to suit the requirements of an application. The characteristics of the antenna may also be modified by the addition of one or more branches 12 (FIG. 5) which do not terminate in connection points, or by the addition of unfed (parasitic) conductive members 13 (FIG. 6) which may optionally be connected to a terminal point.

The relative disposition of the conductive members may optionally be chosen to reduce or enhance the electromagnetic coupling between them according to the performance requirements which are to be achieved.

Figure 7:
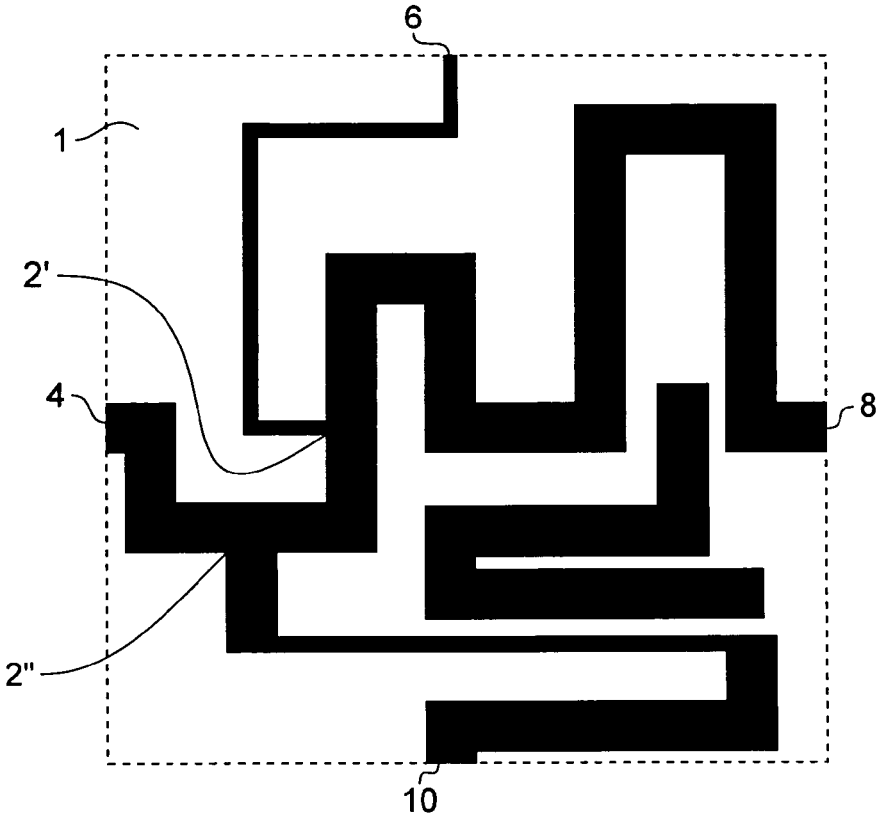
FIG. 7 shows an embodiment incorporating conductive tracks of different widths

The widths of the conductive members may optionally be the same for each member, but in some applications it may be found advantageous if some conductive members or sections thereof are provided with different widths as illustrated by way of example in FIG. 7. This freedom of design permits a wide variety of performance characteristics to be achieved.

Figure 8:
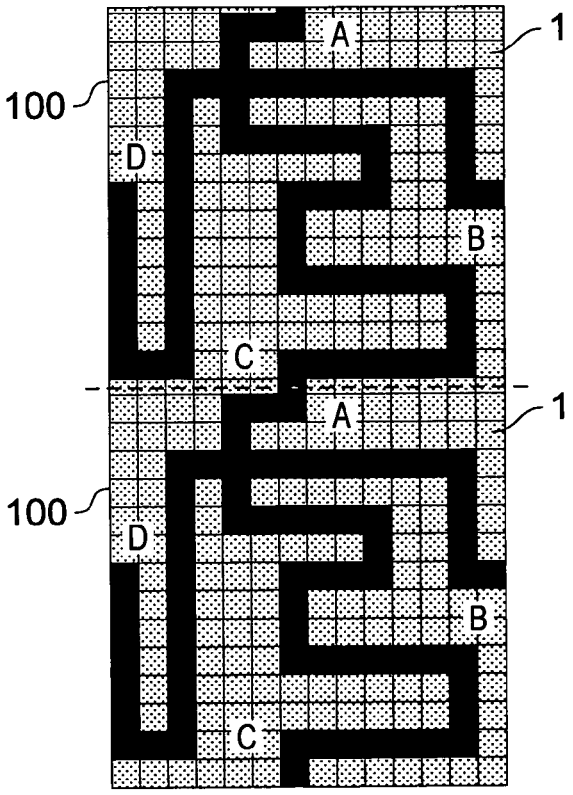
FIG. 8 shows a tiled configuration.
Figure 9:
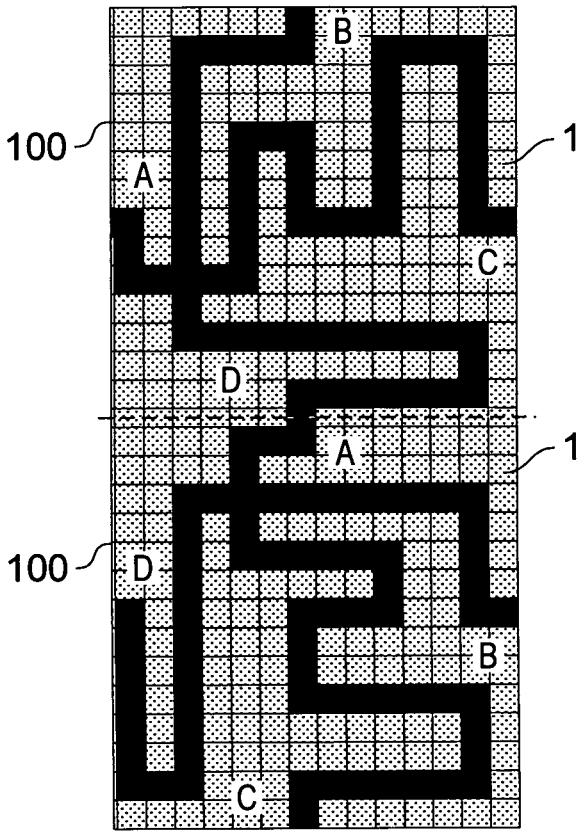
FIGS. 9 and 10 show alternative tiled configurations.
Figure 10:
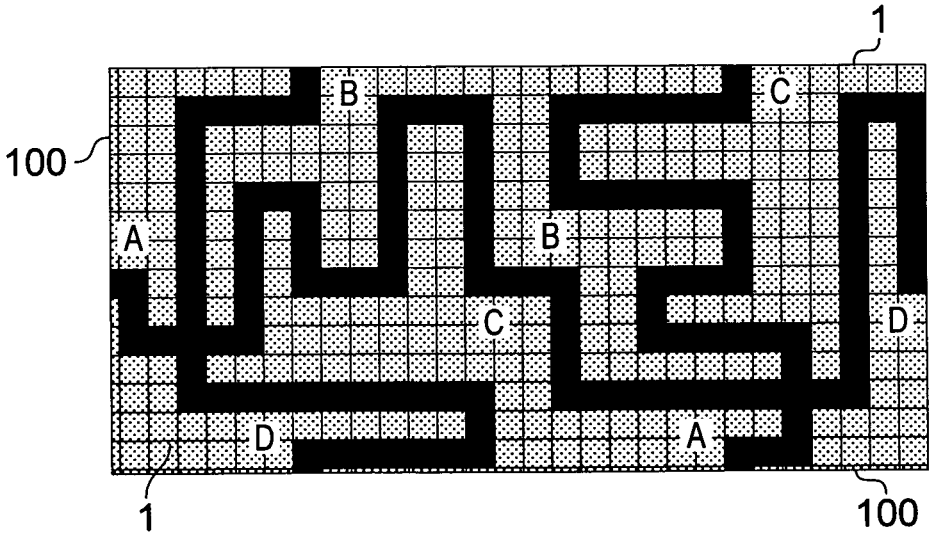
Figure 11A:
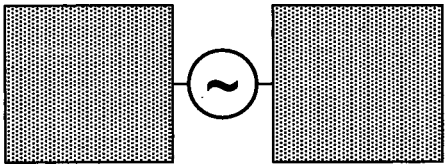
FIG. 11 shows a number of alternative methods for driving the tile antenna.
Figure 11B:
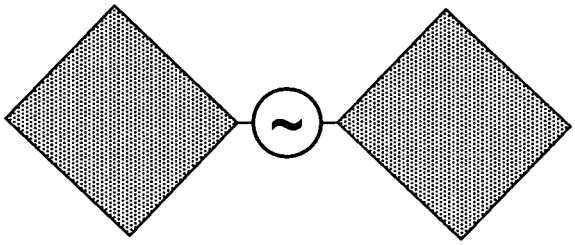
Figure 11C:
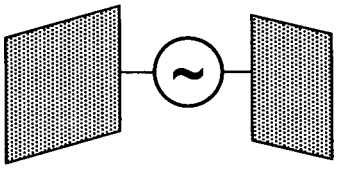
Figure 11D:
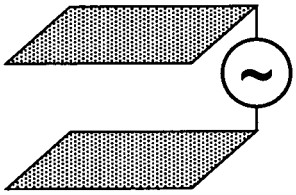
Figure 11E:
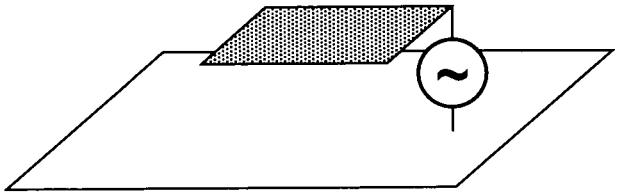
Figure 12:
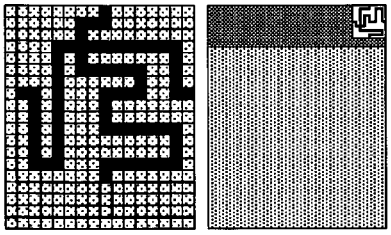
Figure 12:
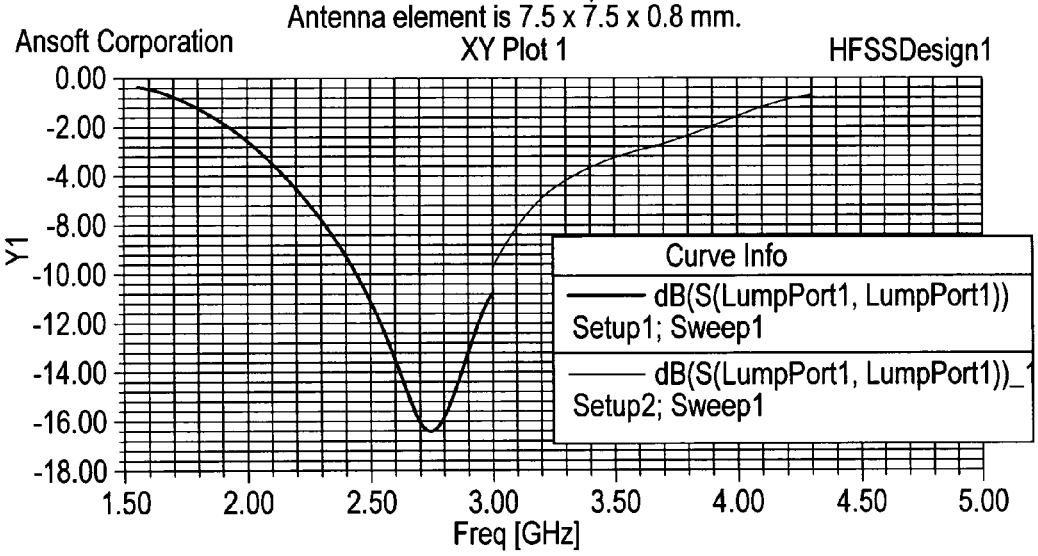
Figure 13:
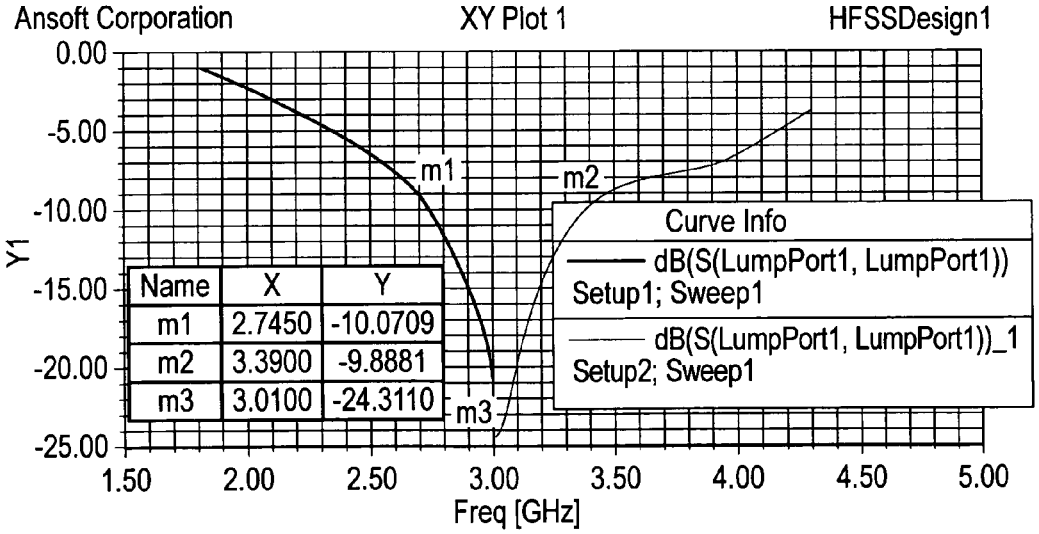
Figure 14:
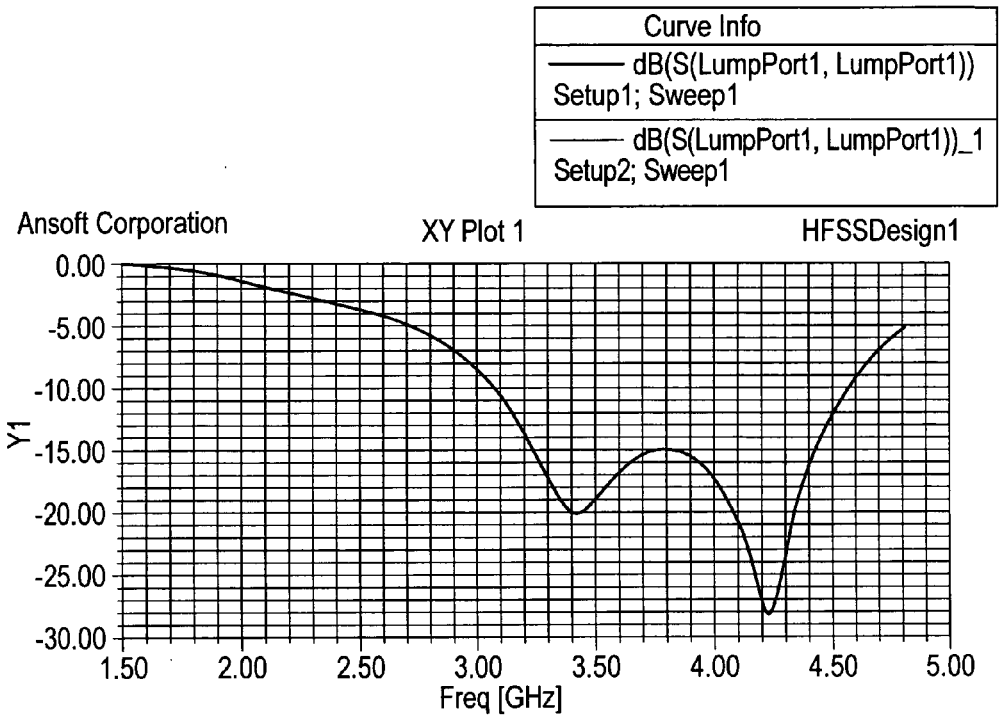
Figure 15:
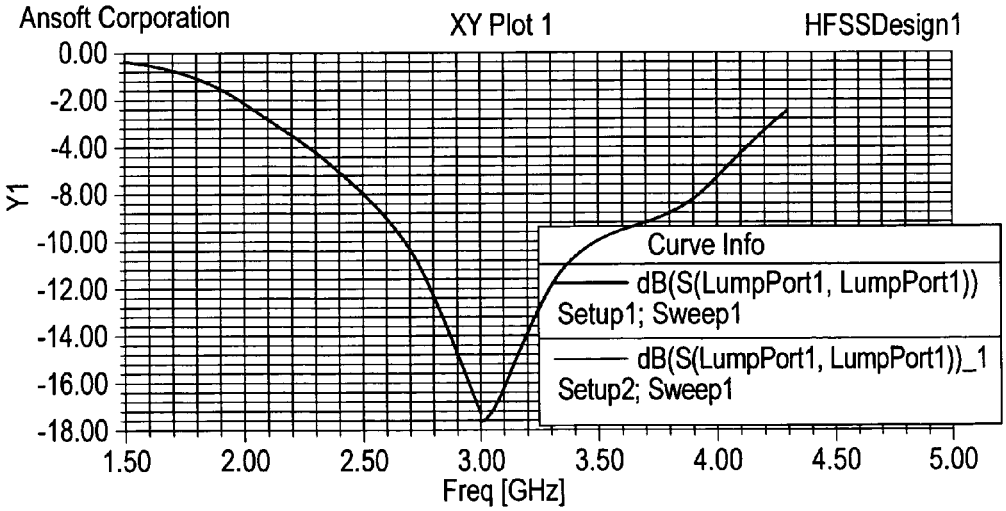
Figure 16:
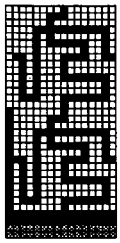
Figure 16:
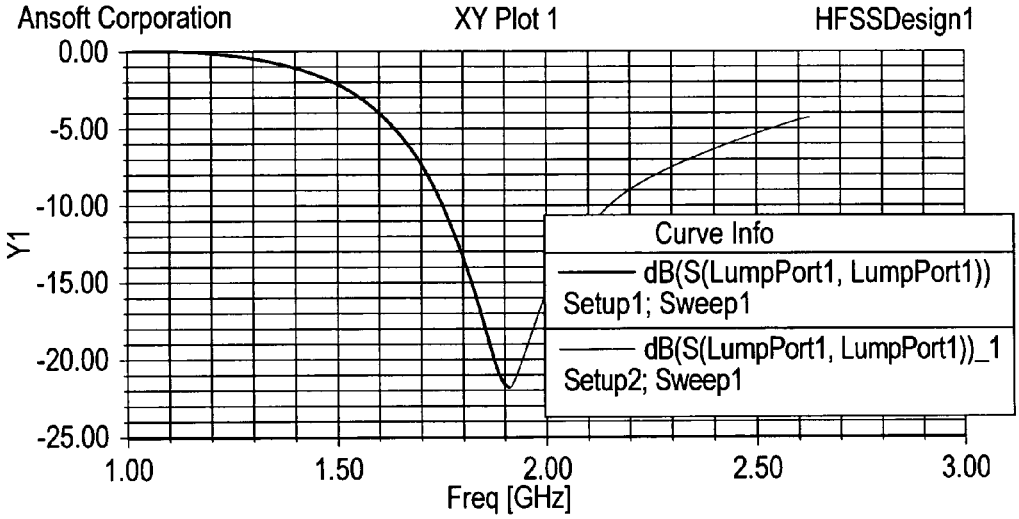
Figure 17:
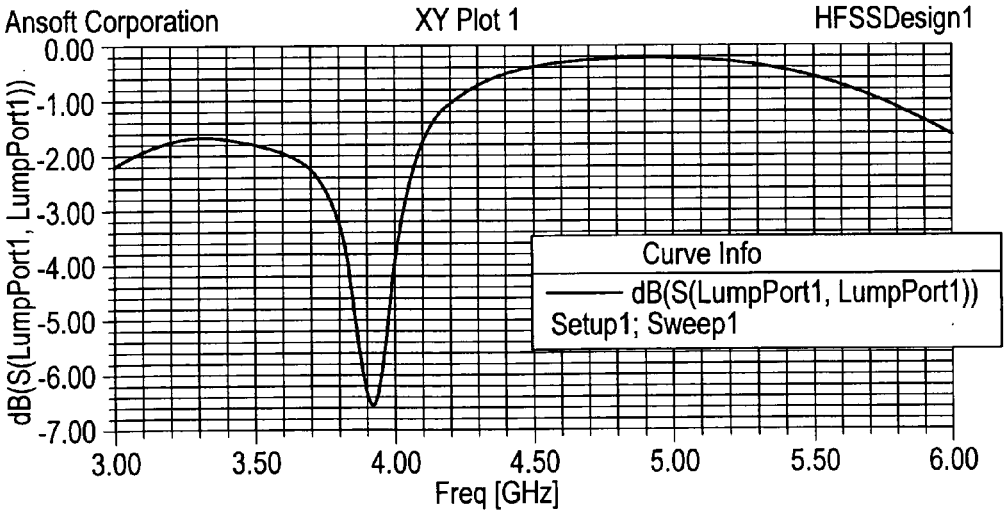
Figure 18:
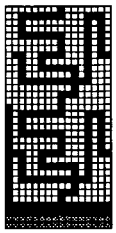
Figure 18:
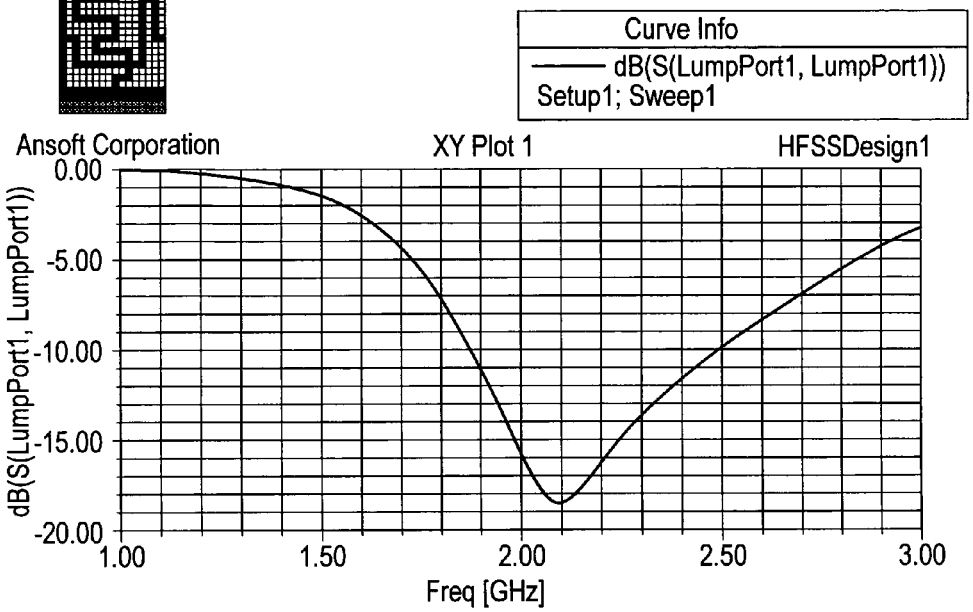
Figure 19:
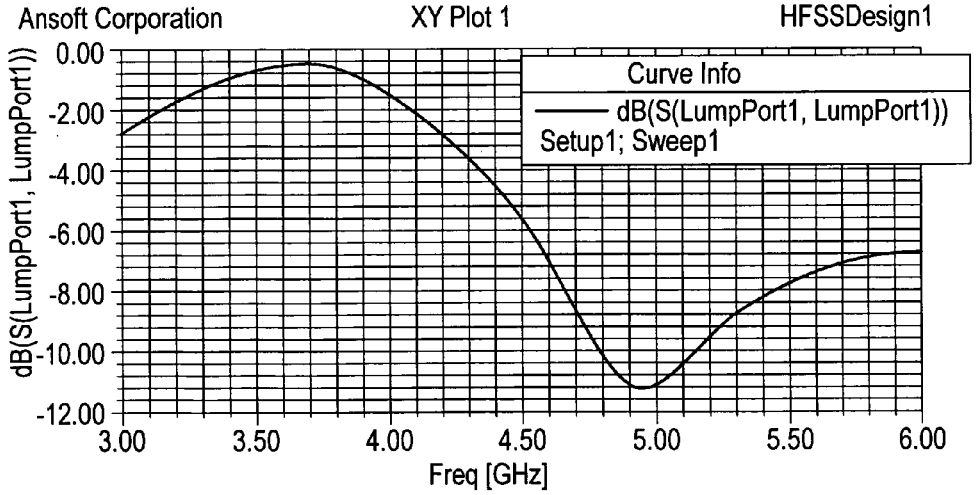
Figure 20:
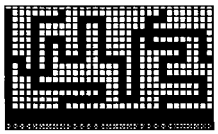
Figure 20:
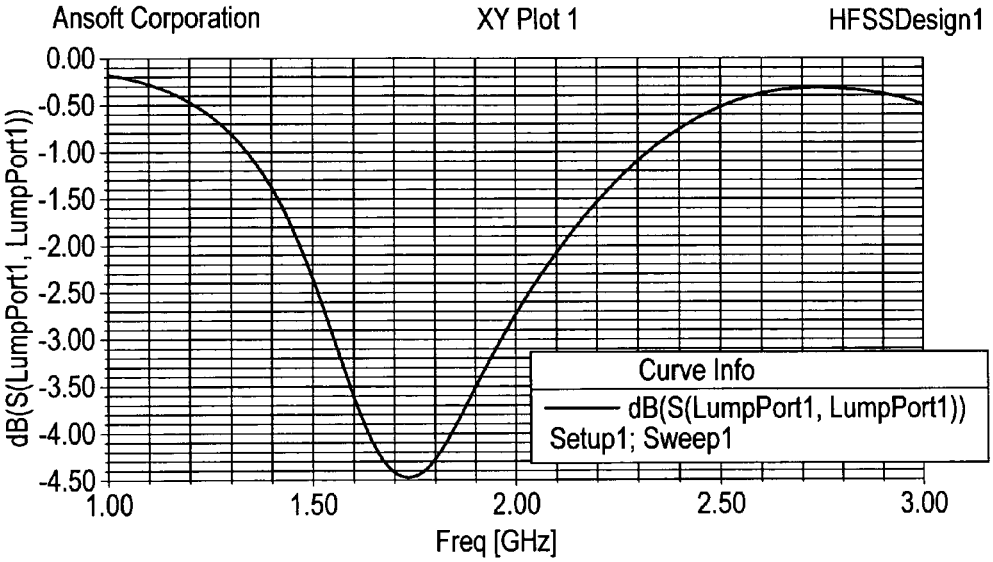
Figure 21:
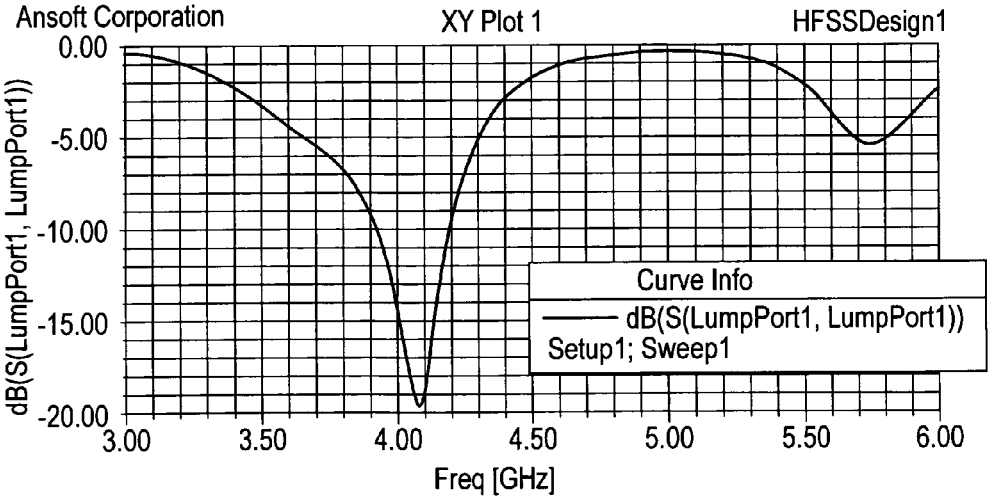
Figure 22:
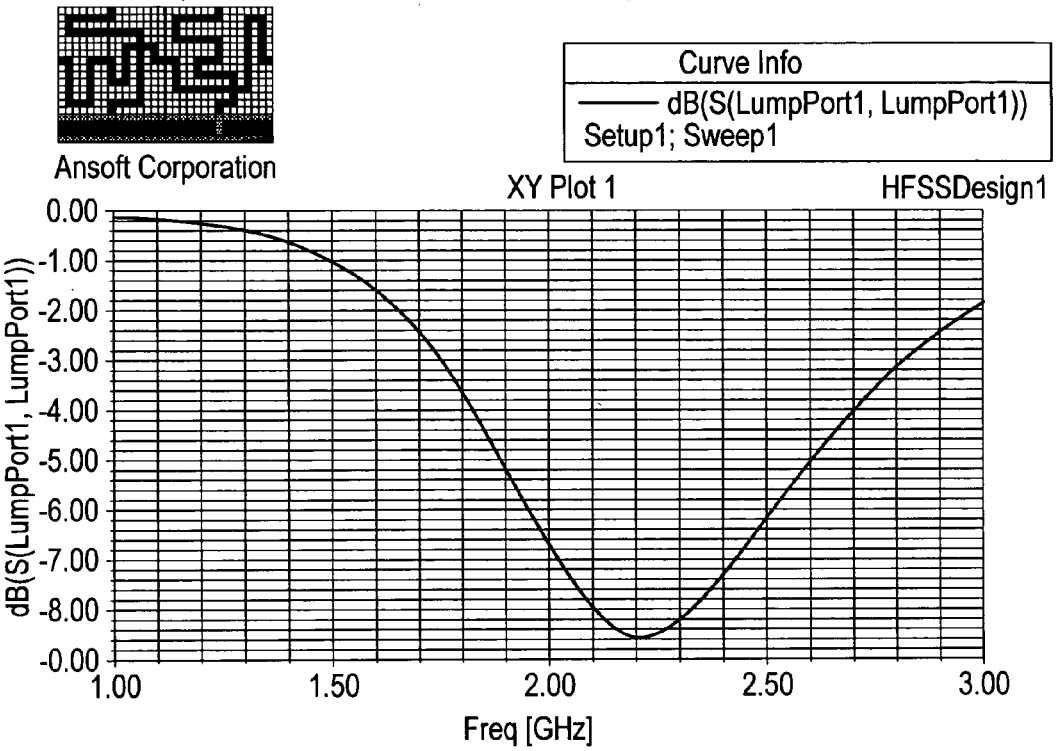
Figure 23:
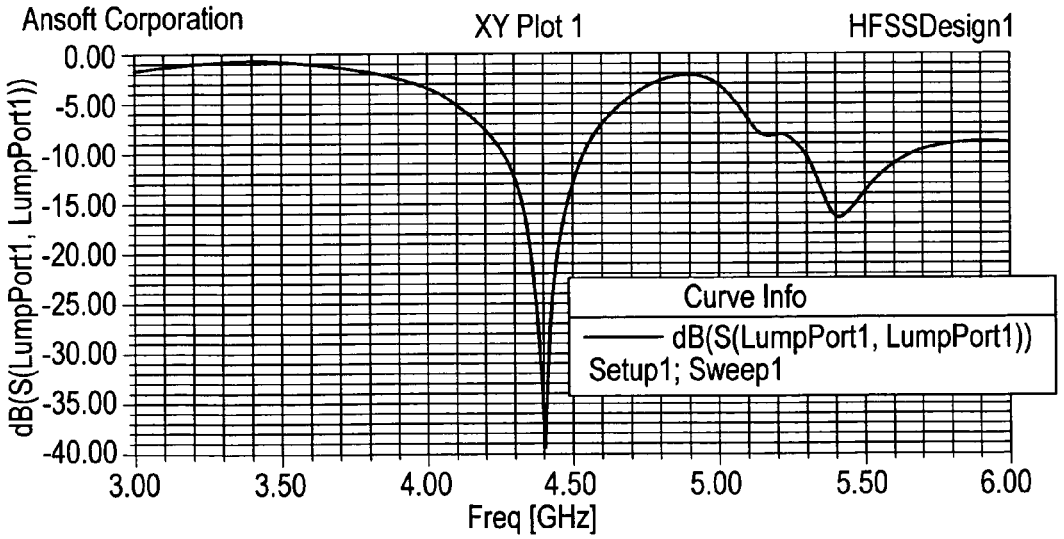

FIGS. 8 to 10 show how a pair of tile-shaped antenna modules of an embodiment of the invention can be connected in series in three different ways so as form three different composite antenna structures. Each module 100 comprises a substrate 1 with a conductive pathway having four arms or branches emanating from a common junction point 2 and terminating at respective terminals A, B, C and D.

Embodiments of the present invention are not restricted to antennas occupying a square planar area but can equally be designed to form other shapes. These may include triangles, rectangles, hexagons or other arbitrary symmetrical or asymmetric shapes. In order to provide the required frequency responses or to fit into the space available in an application platform, it may be found convenient to arrange for the conductive members to lie in more than one plane.

The embodiments illustrated in FIGS. 1 to 10 are shown by way of example have the terminals arranged to be at the mid-points of each side of a square chip. It will be appreciated that this arrangement is by way of example and that other arrangements, including arrangements where the terminals are located at the corners of a square chip or where a plurality of terminals are located on one or more edges of the structure are equally practicable.

The conductive members may be of linear or curvilinear form. They may be aligned with a Cartesian grid as illustrated in FIG. 1 or they may take any alignment desired. The layout of any practical antenna will differ according to the design method used and it is usual to constrain some parameters in order to simplify the design task. The design of a practical device embodying the present invention may conveniently be accomplished using an electromagnetic simulation computer program, optionally in conjunction with a genetic optimization algorithm.

Further variations of the properties of the arrangement may be obtained by connecting passive electronics components such as inductors, capacitors, resistors, transistors or switches singly or in combination, either in series with one or more conductive members or between different conductive members.

A further embodiment of the invention is shown in FIG. 8 in which two chip antennas such as that shown in FIG. 1 are placed together in such a manner that the conductive patterns on each chip are aligned to form a common junction. It will be seen that the assembly of two chips provides an extended branched pattern of conductive members which will have a further set of electrical properties, again dependent on which external terminal is used to excite the conductive structure. Without any change in the conductive pattern on the individual antenna structures there are eight different ways in which the chip antennas can be tiled in this configuration (four orientations of the lower chip each combined with four orientations of the upper chip). One of these is shown by way of example in FIG. 9. It will be appreciated that the flexibility of the possible arrangements is greater if the terminals on individual chips are located symmetrically about the geometrical axes of the chip.

A further embodiment is shown in FIG. 10 in which two chips are tiled in a side-by-side arrangement. There are eight variants of this arrangement but some of these arrangements will have electrical properties in common with one another.

Further variations in the properties of these arrangements may be obtained by connecting active or passive electronics components in series with the interconnections between the chips or between external terminals of one or more chips.

Further possible embodiments of a single chip are shown in FIG. 11. FIG. 11*a* shows a pair of chips as described in FIG. 1 arranged as a balanced antenna. In FIG. 11*b* the terminals of the conductive elements are situated at the corners of the chips rather than at the mid-points of their sides as in FIG. 1 and FIG. 11*a*. In FIG. 11*c* the chips are disposed with their planes substantially at right angles to one another, while in FIG. 11*d* they are placed in parallel planes. FIG. 11*e* shows an unbalanced feed arrangement in which the plane of the chip is oriented to be parallel with an underlying groundplane.

It will be appreciated that each of the arrangements described in the preceding paragraph can be generalised by interconnecting additional chips in a tiled pattern.

Sample Performance Data

The performance of an exemplary embodiment of the invention has been computed to demonstrate the potential of the invention described herein. The basic chip used for this purpose was 7.5 mm×7.5 mm×0.8 mm (h×w×d) and the conductive elements had the pattern shown approximately to scale in FIG. 1. The chip was mounted close to one corner of, and coplanar with, a rectangular conductive groundplane with dimensions 40 mm×60 mm×0.1 mm. The return loss of this antenna structure was computed for a number of different cases using different feed terminals for a single chip antenna and either one or two connected chips. The results are illustrated in FIGS. 12-23 and are summarised in Table 1. No optimization was performed on the exemplary structure; the results provided exemplary in nature, intended as "proof of concept", but do not in any way represent limitations of the invention.

TABLE 1

| Configuration No | Frequency of operation (Return loss >10 dB) |
|---|---|
| 1 | 2.5-3.0 GHz |
| 2 | 2.7-3.3 GHz |
| 3 | 3.1-4.6 GHz |
| 4 | 2.7-3.3 GHz |
| 5 | 3.1-4.75 GHz |
| 6 | 3.2-4.6 GHz |
| 7 | 3.3-5.0 GHz |
| 8 | 1.8-2.2 GHz and 3.9 GHz |
| 9 | 1.9-2.5 GHz and 4.8-5.2 GHz |
| 10 | 3.9-4.2 GHz |
| 11 | 4.25-4.55 GHz and 5.3-5.65 GHz |

The invention claimed is:

1. An antenna system comprising:

a module including a dielectric support and a branched electrically conductive pathway formed on or in the support, the pathway including at least three interconnected arms each having a proximal and a distal end, the proximal ends being joined together or each connected to at least one other of the at least three interconnected arms, and the distal ends being separate from each other and configured as terminals at different edges or corners of the module in such a way that a plurality of modules can be connected together, a terminal of one module being connected to a terminal of another module.

2. An antenna system as claimed in claim 1, wherein the proximal ends of the at least three interconnected arms are joined together at a common junction point.

3. An antenna system as claimed in claim 1, wherein at least two of the proximal ends are joined together at a common junction point, and other proximal ends are connected to the pathway at other locations.

4. An antenna system as claimed in claim 1, comprising at least one further arm or member having a proximal end that it unterminated, and configured as a parasitic member.

5. An antenna system as claimed in claim 4, wherein at least one parasitic member has a distal end that terminates at a connection terminal.

6. An antenna system as claimed in claim 1, wherein at least one arm has a different width from other arms.

7. An antenna system as claimed in claim 1, wherein the conductive pathway is formed in substantially one plane.

8. An antenna system as claimed in claim 1, wherein the conductive pathway is formed in more than one plane.

9. An antenna system as claimed in claim 1, comprising at least one further arm having a distal end or a proximal end that is unterminated, wherein the distal end is not located at an edge or corner of the module.

10. An antenna system as claimed in claim 1, with at least one arm being provided on a topside of a substrate, and at least one arm being provided on an underside of the substrate, the underside being on an opposite side of the substrate to the topside.

11. An antenna system as claimed in claim 10, wherein the arms on opposed sides of the substrate are connected by a conductive connection passing through the substrate.

12. An antenna system as claimed in claim 10, comprising first and second conductive pathways, one on each opposed side of the substrate, and wherein the first and second conductive pathways are symmetrically arranged in a mirror plane defined by a plane of the substrate.

13. An antenna system as claimed in claim 1, in which at least one passive electronic component is connected in series or in parallel with any of the arms.

14. An antenna system as claimed in claim 1, further comprising:

one or more additional modules, at least one terminal of each module being electrically connected to at least one terminal of an adjacent module.

15. An antenna system as claimed in claim 14, wherein not all of the constituent antenna modules are of identical configuration.

16. An antenna system as claimed in claim 14, wherein the constituent antenna modules are so dimensional that connections are facilitated irrespective of their mutual orientation.

17. An antenna system as claimed in claim 14, in which the dimensions and configuration of the arms of the antenna modules are arranged such that an operating frequency of the antenna system is selected by connecting at least one of the terminals of the system to a radio frequency transmission line.

18. The antenna system of claim 1, wherein two of the at least three interconnected arms are configured to simultaneously resonate at different frequencies when a signal feed is attached to another one of the at least three interconnected arms.

19. An antenna system comprising:

an antenna module including a dielectric support and a branched electrically conductive pathway formed on or in the dielectric support, the pathway including at least three interconnected arms each having a proximal and a distal end, the proximal ends being joined together, and the distal ends being separate from each other and configured as terminals at different edges or corners of the antenna module in such a way that a plurality of antenna modules can be connected together, a terminal of one antenna module being connected to a terminal of another antenna module.

20. An antenna system as claimed in claim 19, further comprising:

one or more additional antenna modules, wherein at least one terminal of each antenna module is electrically connected to at least one terminal of an adjacent antenna module.

21. An antenna system comprising:

an antenna module including a dielectric support and a branched electrically conductive pathway formed on or in the dielectric support, the pathway including at least three interconnected arms each having a proximal and a distal end, the proximal ends being joined together and the distal ends being separate from each other and configured as terminals at different edges of the antenna module in such a way that a plurality of antenna modules can be connected together, a terminal of one antenna module being connected to a terminal of another antenna module, wherein at least one arm is provided on a topside of a substrate and at least one arm is provided on an underside of the substrate, the underside being on opposite side of the substrate to the topside.

22. The antenna system of claim 21, further comprising wherein the arms on opposed sides of the substrate are connected by a conductive connection passing through the substrate.

23. An antenna system as claimed in claim 20, wherein the distal ends each terminate at an approximate center of one of the different edges of the antenna module.

24. An antenna system as claimed in claim 23 further comprising:

one or more additional antenna modules forming a planar assembly, wherein at least one terminal on an edge of a first of the one or more antenna modules is electrically connected to at least one terminal on an edge of a second of the one or more antenna modules, the electrically connected antenna modules being physically adjacent to one another.

* * * * *